US007886718B2

(12) United States Patent
Manubolu et al.

(10) Patent No.: US 7,886,718 B2
(45) Date of Patent: Feb. 15, 2011

(54) FUEL INJECTOR HAVING INTEGRAL BODY GUIDE AND NOZZLE CASE FOR PRESSURE CONTAINMENT

(75) Inventors: Avinash R. Manubolu, Edwards, IL (US); Stephen R. Lewis, Chillicothe, IL (US); Shriprasad G. Lakhapati, Peoria, IL (US); Zhenlong Xu, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 207 days.

(21) Appl. No.: 12/286,023

(22) Filed: Sep. 26, 2008

(65) Prior Publication Data

US 2010/0077994 A1 Apr. 1, 2010

(51) Int. Cl.
*F02M 51/06* (2006.01)

(52) U.S. Cl. ..... 123/472; 239/584; 239/585.5

(58) Field of Classification Search ..... 123/470; 239/584, 585.5

See application file for complete search history.

(56) References Cited

U.S. PATENT DOCUMENTS 3,409,225 A * 11/1968 Maddalozzo et al. ..... 239/89
3,980,234 A * 9/1976 Bouwkamp ..... 239/533.11
5,881,957 A 3/1999 Mizuno et al.
6,105,884 A 8/2000 Molnar et al.
6,152,387 A 11/2000 Ricco
6,390,385 B1 * 5/2002 Hardy et al. ..... 239/102.2
6,685,111 B2 2/2004 Ricco
6,688,578 B1 2/2004 Nussio et al.
6,834,812 B2 12/2004 Neretti et al.
6,840,467 B2 1/2005 Dantes et al.
6,851,631 B2 2/2005 Dallmeyer et al.
6,978,770 B2 * 12/2005 Rauznitz et al. ..... 123/498
6,988,681 B2 1/2006 Reiter
7,021,569 B1 4/2006 Ogura et al.
7,097,115 B2 * 8/2006 Jiang et al. ..... 239/88
7,140,353 B1 11/2006 Rauznitz et al.
2002/0030123 A1 3/2002 Haltiner, Jr. et al.
2004/0195389 A1 10/2004 Neumaier et al.
2005/0067512 A1 3/2005 Shimizu et al.
2007/0194151 A1 8/2007 Hayatani et al.

* cited by examiner

*Primary Examiner*—Erick Solis
(74) *Attorney, Agent, or Firm*—Liell & McNeil

(57) ABSTRACT

A fuel injector includes a body piece that defines a nozzle supply passage and a chamber in fluid communication therewith and configured to contain a fluid pressure within the fuel injector. The body piece has a threaded segment and a second, unthreaded segment that includes an outer surface of the fuel injector. A tip piece is clamped via a clamping piece to the body piece to form a fluid seal therewith, and a needle check extends within the body piece and the tip piece. The body piece is configured to contain fluid pressures, for example up to and exceeding 200 MPa, and has a wall thickness between the chamber and the unthreaded segment that is linked to a fluid pressure of fuel passing through the chamber. The fuel injector is configured via integrating portions of a nozzle case and a body guide to contain the extremely high fuel pressures.

20 Claims, 2 Drawing Sheets

FUEL INJECTOR HAVING INTEGRAL BODY GUIDE AND NOZZLE CASE FOR PRESSURE CONTAINMENT

TECHNICAL FIELD

The present disclosure relates generally to fuel injectors, and relates more particularly to a fuel injector having an integral body guide and nozzle case for containing high internal fuel pressures.

BACKGROUND

A great many different designs for fuel injectors are well known and widely used. Over the years, various concerns have driven technological innovation in fuel injectors and other components of fuel systems. Notable among these has been the desire to inject fuel at increasingly high pressures. High fuel pressures have been shown to be associated with relatively greater fuel atomization and the reduction of certain emissions from an associated engine. Recent attempts have been made to inject fuel from a fuel injector into an associated engine cylinder at pressures of 200 MPa or greater. While showing much promise for further improving and optimizing the operation of engine systems, in particular compression ignition diesel engine systems, such extremely high pressures have presented a number of challenges in conventional systems. One known type of fuel injector includes a body guide having a guide bore for a nozzle check, a nozzle chamber and a nozzle casing within which the body guide is received. In research situations, it has been discovered that extremely high fuel pressures within a fuel injector of this type can cause certain components to fail. In particular, in some instances the nozzle cavity can actually crack.

Certain relatively large fuel injectors tend to be more capable of handling extremely high internal fuel pressures. Many engine and fuel system components, however, are purpose built for fuel injectors of a certain size. Simply making fuel injectors larger to handle greater pressures is therefore not desirable in many instances.

SUMMARY

In one aspect, a fuel injector includes a body piece defining a nozzle supply passage and a chamber in fluid communication with the nozzle supply passage and being configured to contain a fluid pressure within the fuel injector. The body piece further includes an inner diameter, and an outer diameter having a body piece threaded segment and a second unthreaded segment that includes an outer surface of the fuel injector. The fuel injector further includes a tip piece having a first end with a sealing land and a second end opposite the first end and having at least one nozzle outlet located therein. A needle check extends within the body piece and the tip piece, the needle check being movable between a first position at which the needle check closes the at least one nozzle outlet and a second position at which the needle check opens the at least one nozzle outlet. The fuel injector further includes a clamping piece having an inner diameter with a clamping piece threaded segment configured to mate with the body piece threaded segment to couple the tip piece with the body piece and fluidly seal the sealing land against the body piece.

In another aspect, a fuel injector includes a fuel injector body having a nozzle subassembly that includes a body piece defining a nozzle supply passage and a chamber in fluid communication with the nozzle supply passage. The fuel injector body further includes a tip piece having at least one nozzle outlet therein and a needle check extending within the body piece and the tip piece. The body piece is configured to contain a fluid pressure within the fuel injector body. The body piece has a first body piece end and a second body piece end and includes an outer surface of the fuel injector body located between the first body piece end and the second body piece end. The fuel injector body further includes a first clamping region located proximate the first body piece end and having a first set of components which includes the tip piece clamped to the first body piece end, and a second clamping region proximate the second body piece end and having a second set of components clamped to the second body piece end.

In still another aspect, a method of operating an engine having a fuel system with at least one fuel injector includes a step of increasing a pressure of a fuel within the fuel system from a first pressure to an elevated pressure, and injecting the fuel into a cylinder of the engine at least in part by opening a nozzle valve of the at least one fuel injector in response to a change in an electrical energy state of an electrical actuator. The method further includes a step of containing fuel pressure within the fuel injector at least in part via a first seal formed between a first body piece and a tip piece of the fuel injector, a second seal formed between the first body piece and a second body piece of the fuel injector and a pressure containing chamber wall of the first body piece having a material thickness between an outer surface of the fuel injector and an inner surface of the first body piece which is based at least in part on a magnitude of the elevated pressure.

DETAILED DESCRIPTION

Figure 1:
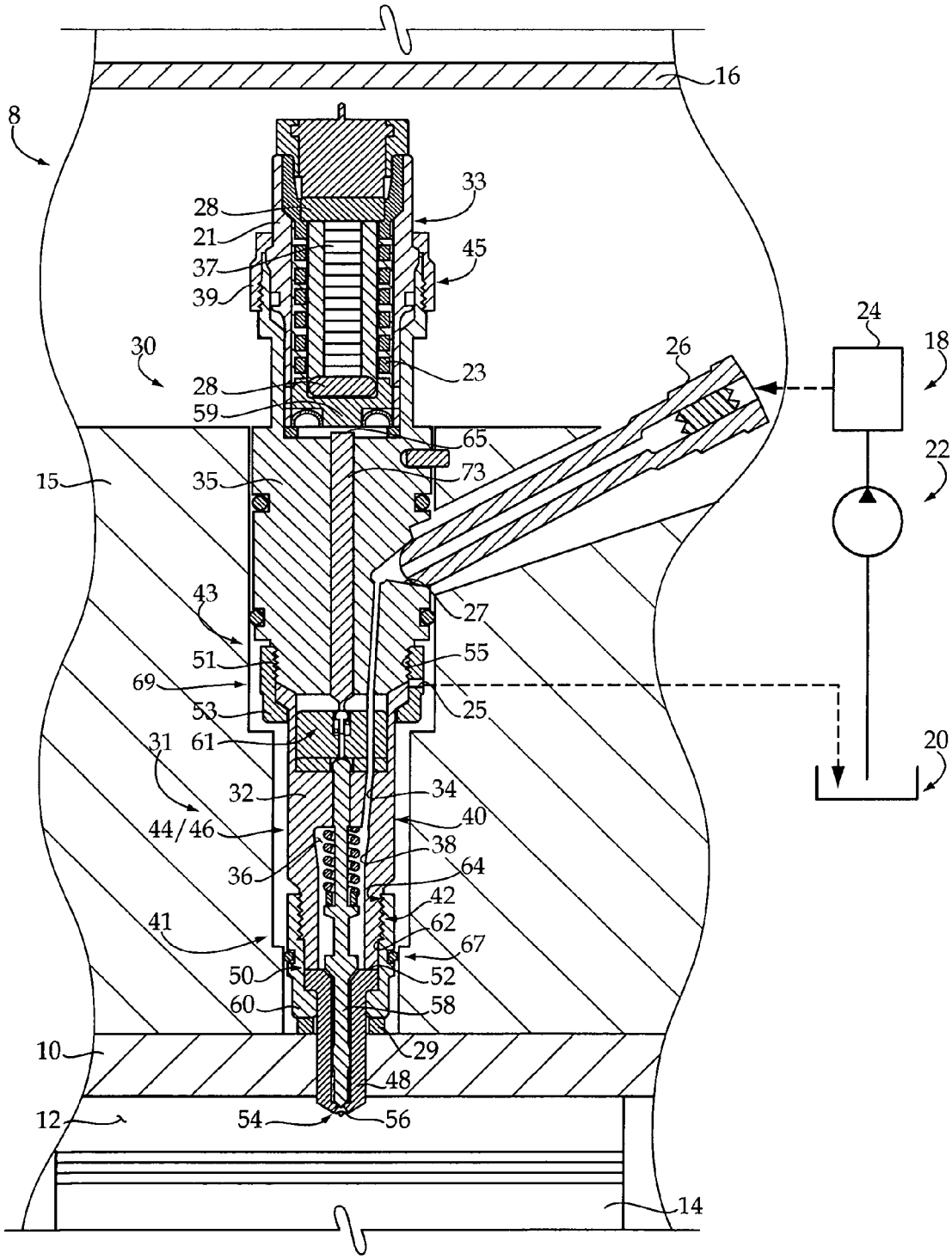
FIG. 1 is a partially sectioned side diagrammatic view of an engine according to one embodiment.

Referring to FIG. 1, there is shown an engine 8 according to one embodiment. Engine 8 may include an engine housing 10 having one or more cylinders 12 formed therein, each with a piston 14 associated therewith. In one embodiment, engine 8 may include a compression ignition diesel engine, however the present disclosure is not thereby limited. A fuel injector 30 may be associated with cylinder 12, and in one embodiment may be configured to directly inject a fuel therein. Engine 8 may include a plurality of cylinders, each having a fuel injector associated therewith and configured for direct injection. Fuel injector 30 may have an injector body including a plurality of body components uniquely configured to facilitate pressure containment. Fuel injector 30 may be positioned within an engine head 15 and seated on a ring 29 in a conventional manner. Engine 8 may further include a valve cover 16 conventionally positioned relative to engine head 15 and fuel injector 30, and any such other fuel injectors as might be used. Engine 8 may further include a fuel system 18, including a fuel tank 20, a high pressure pump 22 and a common rail 24. Common rail 24 may supply a fuel at a relatively high pressure to fuel injector 30 via a quill connector 26 in a conventional manner. In other embodiments, rather than a common rail a unit pump or some other pressurization system might be used to supply pressurized fuel to fuel injector 30. In still other embodiments, fuel pressurization might take place within fuel injector 30, such as via a fuel pressurization plunger or the like.

Quill connector 26 may connect with a high-pressure inlet 27 formed in a body piece 35 of fuel injector 30. Fuel injector 30 may also include a nozzle subassembly 31 coupled with body piece 35. Body piece 35 and one or more components of nozzle subassembly 31 may together define a nozzle supply passage 34. Nozzle supply passage 34 may connect with a nozzle chamber 36, which is in turn connected with one or more nozzle outlets 56 fluidly communicating with cylinder 12 in a conventional manner. Nozzle subassembly 31 may include another body piece 32, which defines a portion of nozzle supply passage 34 and also defines a portion of nozzle chamber 36. Nozzle chamber 36 may also be defined in part by a tip piece 48 fluidly sealed with body piece 32, in a manner further described herein. In one embodiment, body piece 32 may include an inner diameter 38, and an outer diameter 40. Outer diameter 40 may include a threaded segment 42 and an unthreaded segment 44 which includes an outer surface 46 of fuel injector 30. As will be further apparent from the following description, body piece 32 may be understood as an integral body guide and nozzle case, serving functions in fuel injector 30 that are analogous to functions served by separate body guide and nozzle case components used in earlier designs.

Figure 2:
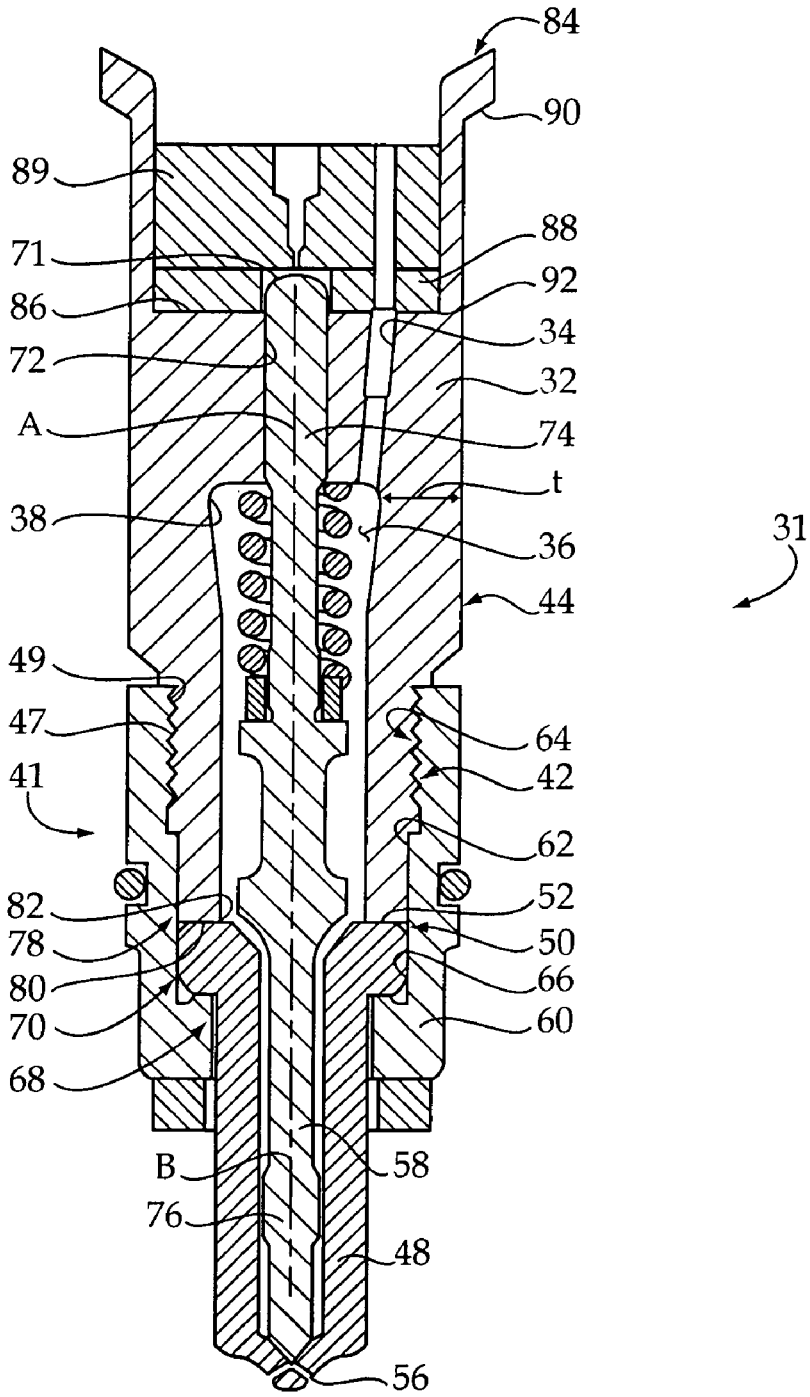
FIG. 2 is a sectioned side view of a nozzle subassembly according to one embodiment.

Tip piece 48 may include a first end 50 having a sealing land 52 thereon, and a second end 54 opposite first end 50 where at least one nozzle outlet 56 is located. A nozzle valve such as a needle check 58 extends within body piece 32 and tip piece 48, and is movable between a first needle check position at which needle check 58 blocks nozzle outlets 56 and a second needle check position at which needle check 58 does not block nozzle outlets 56. Fuel injector 30 may further include an actuator subassembly 33 and a control valve assembly 61 operably coupled therewith, which are together configured to operate needle check 58 to move needle check 58 between the first and second positions to control an injection of fuel into cylinder 12. Referring also to FIG. 2, needle check 58 may include a control surface 71 exposed to a control pressure which is varied by actuating control valve assembly 61 via changing an electrical energy state of actuator subassembly 33, such as energizing or de-energizing.

In one embodiment, actuator subassembly 33 may include an electrical actuator such as a piezoelectric actuator 37 having a piezoelectric stack, configured to change in length responsive to energizing, de-energizing or otherwise changing an electrical energy state thereof, in a known manner. Piezoelectric actuator 37 may be positioned within a casing 21, and preloaded via a preloading spring 23. A preload control mechanism 28 may be further provided which allows preload on piezoelectric actuator 37 to be maintained or controlled as desired across a range of temperatures by expanding or contracting in response to temperature changes. Control valve assembly 61 may include a first control valve element 73 and a second control valve element 63, positioned within fuel injector 30. In one embodiment, preloading spring 23 may include a contact element 59 which is configured to contact control valve element 73 by traversing a gap 65 when piezoelectric actuator 37 is activated. Contact element 59 can thereby adjust a position of control valve element 73, in turn controlling a position of control valve element 63 to vary a pressure acting on control surface 71. A drain 25 is further provided in fuel injector 30, and communicates low pressure to control surface 71 when control valve assembly 61 is activated, in a known manner, to allow pressure of fuel in chamber 36 to lift needle check 58 and initiate fuel injection. When piezoelectric actuator 37 is deactivated, control valve assembly 61 will adjust such that high pressure is returned to control surface 71 and injection is terminated.

As alluded to above, body piece 32 may be uniquely configured to contain a fluid pressure within fuel injector 30. Body piece 32 may be a middle body piece of fuel injector 30, meaning that body piece 32 may be between other body pieces. Body piece 32 may also have a first body piece end 78 including an end face 80, and a second body piece end 84 including a shoulder 90. In one embodiment, end face 80 may abut sealing land 52 of tip piece 48 to form a first metal-to-metal seal 82 with sealing land 52. A second end face 86 may be formed on body piece 32, and may abut another body piece 88 to form a second metal-to-metal seal 92 with body piece 88. Yet another body piece 89 may be positioned between body piece 88 and body piece 35 in one embodiment. A portion of unthreaded segment 44 which includes outer surface 46 of fuel injector 30 may be located between body piece end 78 and body piece end 84.

Fuel injector 30 may be assembled in a unique manner, further described herein, and may include a set of clamping mechanisms 67, 69 for holding the various components together in an assembled state. In one embodiment, fuel injector 30 may include a first clamping mechanism 67 at a first clamping region 41 located proximate first body piece end 78, and having a first set of components which includes tip piece 48 clamped to body piece end 78. Fuel injector 30 may also include a second clamping mechanism 69 at a second clamping region 43 proximate second body piece end 84, and having a second set of components clamped to second body piece end 84. The second set of components may include body pieces 88, 89 and 35. Fuel injector 30 may further include a third clamping region 45. Third clamping region 45 may include a clamping piece 39 threadedly engaged with body piece 35 to clamp actuator subassembly 33 therewith via interaction with third clamping region 45.

Shoulder 90 may be located in second clamping region 43. Fuel injector 30 may include another clamping piece 53 having a set of internal threads 55 which are configured to mate with a set of external threads 51 formed on body piece 35, such that threaded engagement between the sets of threads 51 and 55 can clamp body piece 32 with body pieces 88, 89 and 35, plus potentially other body pieces, via interaction of clamping piece 53 with shoulder 90. In one embodiment, interaction between threads 55 and 51 can compress the body pieces associated with second clamping region 43 to form metal-to-metal seal 92.

As mentioned above, body piece 32 may also include a threaded segment 42, which includes a set of external threads 47. Fuel injector 30 may include another clamping piece 60, part of clamping region 41, which has an inner diameter 62 with unthreaded segment 66 and a threaded segment 64 which includes a set of internal threads 49. Interaction between internal threads 49 and external threads 47 can clamp tip piece 48 to body piece 32. It should be appreciated that descriptions herein of "threads" or "threaded" should be understood to include designs actually having multiple threads as well as designs having only a single thread. In one embodiment, clamping of tip piece 48 with body piece 32 via interaction between threads 47 and 49 can form metal-to-metal seal 82.

Clamping of clamping piece 60 with body piece 32 may also be used in one embodiment to properly locate tip piece 48 relative to body piece 32. Body piece 32 may define a first center axis "A", whereas tip piece 48 may define a second center axis "B". As mentioned above, sealing land 52 may be formed on end 50 of tip piece 48. In one embodiment, end 50 may be a terminal end, having sealing land 52 located thereon. Adjacent end 50 may be a locating surface 70 formed on an outer diameter 68 of tip piece 48. It will be recalled that clamping piece 60 includes an unthreaded segment 66. Locating surface 70 may be configured via interacting with unthreaded segment 66 to align first center axis A with second center axis B. In other words, when clamping piece 60 is threadedly engaged with body piece 32, it may coaxially align axes A and B. Thus, clamping piece 60 may be understood as locating tip piece 48 and body piece 32 in a desired orientation/location relative to one another. It will generally be desirable to utilize a relatively tight clearance between locating surface 70 and unthreaded segment 66. Sealing land 52 and locating surface 70 will typically have a relatively high degree of perpendicularity, although in many instances it will be possible via engaging threads 47 and 49 to clamp tip piece 48 to body piece 32 with sufficient force that a relatively mild lack of perpendicularity between locating surface 70 and unthreaded segment 66 will be ameliorated during assembly.

Inner diameter 38 of body piece 32 may define a guide bore 72. Needle check 58 may include a first guide element 74 which guides needle check 58 via interacting with guide bore 72, as well as a second guide element 78 which guides needle check 58 via interacting with tip piece 48. In one further embodiment, first guide element 74 may have a first guide clearance with guide bore 72, and second guide element 76 may have a second guide clearance with tip piece 48 which is relatively larger than the first guide clearance. Those skilled in the art will appreciate that various factors may influence how tight the selected clearance between guide element 74 and guide bore 72 should be. For instance, where guide element 74 and guide bore 72 interact over a relatively greater length, a larger clearance may be appropriate, whereas a relatively shorter length of interaction/contact may make a relatively tighter clearance appropriate. As mentioned above, the guide clearance between guide element 74 and guide bore 72 will typically be relatively tighter, such that guiding/locating of needle check 58 may be influenced more by interaction/contact with guide bore 72 than by interaction/contact with tip piece 48. The aforementioned locating features and the guide interaction between guide bore 72 and guide element 74, in cooperation with the different clearances associated with each of guide elements 74 and 76, can ensure that needle check 58 seats properly on outlets 56 when fuel injector 30 is assembled for operation.

INDUSTRIAL APPLICABILITY

As discussed above, in many conventional fuel injector designs, certain fuel injector components have been demonstrated to have a tendency to crack when subjected to extremely high internal pressures. The present disclosure addresses concerns such as fracturing, leakage, etc. associated with fuel pressures approaching and even exceeding 200 MPa, by making available additional wall thickness in body piece 32 to contain these extremely high fuel pressures. It has been discovered that a potential stress concentration point in certain fuel injectors exists at the intersection of the conventional heart shaped nozzle cavity with the supply passage therefor. Referring in particular to FIG. 2, body piece 32 may have a continuous material thickness "t" between inner diameter 38 and outer diameter 40 which is linked to a magnitude of the fuel pressure expected to exist, at least periodically, and in some cases substantially continuously, in chamber 36. In contrast to certain earlier designs, no outer encasement such as a nozzle case or other structure is positioned about body piece 32. Thus, outer diameter 40 of body piece 32 is the outer diameter of fuel injector 30. This allows additional continuous material thickness between inner diameter 38 and outer diameter 40 without creating packaging issues, such that pressure containment can be improved over conventional designs without changing the size or configuration of the fuel injectors used in a particular application.

Also alluded to above are differences in the manner of assembling fuel injector 30 as compared to many known designs. Many conventional fuel injectors include a nozzle case that is positioned around a stack of components. The nozzle case in a conventional fuel injector typically includes one or more nozzle outlets at one end, and is open at an opposite end. To assemble such injectors, the stack of components is typically loaded into the open end, then some mechanism is used to compress the entire stack down into the nozzle case, and secure it under load. In the present design, no nozzle case is used, thereby enhancing pressure containment due to the greater available wall thickness t. In dispensing with a separate nozzle case, and instead forming body piece 32 as a component integrating both the body piece and nozzle case, components may be coupled with body piece 32 at each of its two ends. Because of this, each metal-to-metal seal 82 and 92 is enabled by a separate clamping mechanism 67, 69, rather than relying upon forming multiple seals via compression of a single stack of components.

Fuel injector 30, and fuel system 18, may be operated in a manner similar to that of many known fuel injectors. Fuel may be increased in pressure via high-pressure pump 22 from a first pressure to an elevated pressure, then supplied via common rail 24 to quill connector 26. From quill connector 26, fuel may be supplied via inlet 27 to nozzle supply passage 34, and thenceforth to nozzle chamber 36. As mentioned above, pressure of the fuel supplied to nozzle chamber 36 may be equal to at least about 200 MPa. It will be recalled from the foregoing discussion that certain earlier fuel injectors tended to crack approximately in a region where a nozzle supply passage met a heart shaped nozzle chamber. In the present design, the continuous material thickness between inner diameter 38, which includes a wetted inner surface of fuel injector 30, and outer diameter 40 enhances the ability of nozzle chamber 36 to contain extremely high pressures, in cooperation with, metal-to-metal seals 82 and 92. Metal-to-metal seal 82 is maintained via threaded engagement between internally threaded clamping piece 60 and body piece 32, whereas metal-to-metal seal 92 is maintained via threaded engagement between internally threaded clamping piece 53 and body piece 35. It should be appreciated that other internally or externally threaded, or unthreaded, clamping mechanisms than those shown and described herein might be used in other embodiments. When a fuel injection is desired, control valve assembly 61 may be adjusted from a first control valve state where high pressure of nozzle supply passage 34 is applied to control surface 71 to a second control valve state where a relatively lower pressure is applied to control surface 71 via energizing actuator 37. In response, needle check 58 will tend to move to the position at which nozzle outlets 56 are open, thereby injecting fuel into cylinder 12. Piston 14 may increase pressure within cylinder 12 to a compression ignition threshold to combust the injected fuel.

The present disclosure offers a strategy for containing extremely high fuel pressures within a fuel injector body. The extremely high fuel pressures available for injection are considered to improve certain engine emissions. The present disclosure also enables sufficient pressure containment without creating packaging issues. In other words, by forming body piece 32 as essentially an integration of a nozzle case and body guide, fuel injector 30 may be used in existing service applications, without needing to reconfigure any of the associated hardware.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent from an examination of the attached drawings and appended claims.

What is claimed is:

1. A fuel injector comprising:

a body piece defining a nozzle supply passage and a chamber in fluid communication with the nozzle supply passage and being configured to contain a fluid pressure within the fuel injector, the body piece further including an inner diameter, and an outer diameter having a body piece threaded segment and a second, unthreaded segment that includes an outer surface of the fuel injector;

a tip piece including a first end having a sealing land and a second end opposite the first end and having at least one nozzle outlet located therein;

a needle check extending within the body piece and the tip piece, the needle check being movable between a first position at which the needle check closes the at least one nozzle outlet and a second position at which the needle check opens the at least one nozzle outlet; and a clamping piece including an inner diameter having a clamping piece threaded segment configured to mate with the body piece threaded segment to couple the tip piece with the body piece, and fluidly sealing the sealing land against the body piece.

2. The fuel injector of claim 1 wherein the first end of the tip piece includes a terminal end and the sealing land is located on the terminal end.

3. The fuel injector of claim 2 wherein the inner diameter of the clamping piece includes an inner unthreaded segment and the tip piece includes an outer diameter having a locating surface thereon, wherein the body piece defines a first center axis and the tip piece defines a second center axis and wherein the locating surface engages with the inner unthreaded segment to align the first center axis and the second center axis.

4. The fuel injector of claim 1 wherein the body piece defines a guide bore, wherein the needle check includes a first guide element which guides the needle check via interacting with the guide bore and a second guide element which guides the needle check via interacting with the tip piece.

5. The fuel injector of claim 4 wherein the first guide element has a first guide clearance with the guide bore, and wherein the second guide element has a second guide clearance with the tip piece, the second guide clearance being relatively larger than the first guide clearance.

6. The fuel injector of claim 1 wherein:

the body piece includes a first body piece end having a first end face abutting the sealing land to form a first metal-to-metal seal between the first end face and the sealing land, and a second body piece end opposite the first body piece end and having a second end face abutting a second body piece of the fuel injector; and the second unthreaded segment of the outer diameter of the body piece is located between the body piece threaded segment and the second end and includes a shoulder for clamping the body piece with the second body piece to form a second metal-to-metal seal between the second end face and the second body piece.

7. The fuel injector of claim 6 wherein the chamber includes a first portion of a nozzle chamber of the fuel injector, the tip piece defining a second portion of the nozzle chamber of the fuel injector.

8. A fuel injector comprising:

a fuel injector body having a nozzle subassembly that includes a body piece defining a nozzle supply passage and a chamber in fluid communication with the nozzle supply passage, a tip piece having at least one nozzle outlet therein and a needle check extending within the body piece and the tip piece;

the body piece configured to contain a fluid pressure within the fuel injector body, and having a first body piece end and a second body piece end and including an outer surface of the fuel injector body located between the first body piece end and the second body piece end; and the fuel injector body further including a first clamping region located proximate the first body piece end and having a first set of components which includes the tip piece clamped to the first body piece end, and a second clamping region proximate the second body piece end and having a second set of components clamped to the second body piece end, the second set of components including a second body piece defining a high pressure fuel inlet from the outer surface of the fuel injector body.

9. The fuel injector of claim 8 wherein the first clamping region includes a set of external threads and the first set of components includes a clamping piece having an inner diameter with a threaded segment having a set of internal threads configured to mate with the set of external threads for clamping the tip piece to the body piece and forming a metal-to-metal seal therebetween.

10. The fuel injector of claim 9 wherein the inner diameter of the clamping piece includes an unthreaded segment and the tip piece includes an outer diameter having a locating surface thereon configured to interact with the unthreaded segment to locate the tip piece relative to the body piece.

11. The fuel injector of claim 9 wherein the body piece is a first body piece, wherein the second clamping region includes a shoulder and the second body piece having a second set of external threads, and the second set of components includes a second clamping piece configured to engage the shoulder and having a second set of internal threads configured to mate with the second set of external threads to clamp the second set of components to the first body piece.

12. The fuel injector of claim 11 further comprising an actuator subassembly and a third clamping piece, wherein the fuel injector body includes a third clamping region and the third clamping piece is configured to clamp the actuator subassembly to the second body piece via interaction with the third clamping region.

13. The fuel injector of claim 12 wherein the actuator subassembly includes an electrical actuator and a contact element, the fuel injector further including a control valve assembly coupled between the actuator subassembly and the nozzle subassembly and including a first control valve element actuated via the contact element in response to energizing the electrical actuator, and a second control valve element actuated via the first control valve element, the first control valve element and the contact element defining a gap therebetween when the electrical actuator is de-energized.

14. The fuel injector of claim 8 wherein the body piece includes an inner diameter defining a guide bore and an outer diameter which includes the outer surface of the fuel injector body, wherein the needle check includes a first guide element which guides the needle check via interacting with the guide bore and a second guide element which guides the needle check via interacting with the tip piece.

15. The fuel injector of claim 14 wherein the needle check has a first guide clearance with the guide bore and a second guide clearance with the tip piece, the second guide clearance being relatively larger than the first guide clearance.

16. A method of operating an engine having a fuel system with at least one fuel injector, the method comprising the steps of:

increasing a pressure of a fuel within the fuel system from a first pressure to an elevated pressure;

injecting the fuel into a cylinder of the engine at least in part by opening a nozzle valve of the at least one fuel injector in response to a change in an electrical energy state of an electrical actuator; and containing fuel pressure within the fuel injector at least in part via a first seal formed between a first body piece and a tip piece of the fuel injector, a second seal formed between the first body piece and a second body piece of the fuel injector, and a pressure containing chamber wall of the first body piece having a material thickness between an outer surface of the fuel injector and an inner surface of the first body piece which is based at least in part on a magnitude of the elevated pressure.

17. The method of claim 16 wherein the step of increasing includes increasing the pressure of the fuel in a common rail of the engine to a pressure equal to at least about 200 MPa.

18. The method of claim 17 wherein the step of containing further includes the steps of maintaining the first seal via threaded engagement between a first internally threaded clamping mechanism and the first body piece and maintaining the second seal via threaded engagement between a second internally threaded clamping mechanism and the second body piece.

19. The method of claim 18 further including a step of adjusting a control valve for the nozzle valve from a first control valve state to a second control valve state at least in part by energizing the electrical actuator, and wherein the step of injecting further includes relieving a fluid pressure on a control surface of the nozzle valve in response to adjusting the control valve from the first control valve state to the second control valve state.

20. The method of claim 19 wherein the step of injecting includes directly injecting the fuel into the cylinder, the method further including a step of compression igniting the fuel within the cylinder.

* * * * *